US010403179B2

(12) United States Patent
Bass

(10) Patent No.: US 10,403,179 B2
(45) Date of Patent: Sep. 3, 2019

(54) ROLLER DISPLAY DEVICE

(71) Applicant: David B. Bass, Parkland, FL (US)

(72) Inventor: David B. Bass, Parkland, FL (US)

( * ) Notice: Subject to any disclaimer, the term of this patent is extended or adjusted under 35 U.S.C. 154(b) by 0 days.

(21) Appl. No.: 16/133,406

(22) Filed: Sep. 17, 2018

(65) Prior Publication Data

US 2019/0088169 A1 Mar. 21, 2019

Related U.S. Application Data

(60) Provisional application No. 62/560,067, filed on Sep. 18, 2017.

(51) Int. Cl.
*G09F 11/26* (2006.01)
*B42F 17/28* (2006.01)

(52) U.S. Cl.
CPC ..... *G09F 11/26* (2013.01); *B42F 17/28* (2013.01)

(58) Field of Classification Search
CPC ..... G09F 11/26; B42F 17/28
See application file for complete search history.

(56) References Cited

U.S. PATENT DOCUMENTS 302,723 A * 7/1884 Grimes ..... G09F 11/26 40/525
1,551,458 A * 8/1925 Betterly ..... G09F 11/26 194/295
2,054,459 A 9/1936 Burt
2,298,990 A * 10/1942 Utne ..... G09F 11/26 40/472
2,752,705 A 7/1956 Ebersold
3,195,242 A 7/1965 Ward et al.
3,466,776 A 9/1969 Page
3,497,969 A 3/1970 Schwoegler
3,513,577 A * 5/1970 Kleinman ..... G09F 11/29 40/518
3,543,425 A * 12/1970 Schuessler ..... G09F 11/26 40/117
3,734,587 A 5/1973 Karper
3,991,498 A * 11/1976 Beach ..... G09B 19/08 40/518
4,079,531 A 3/1978 Norris et al.
5,016,373 A 5/1991 Theno
5,105,185 A * 4/1992 Nakanowatari ..... G09F 11/26 345/208
5,174,055 A 12/1992 Aiken
5,465,956 A 11/1995 Takemoto et al.
(Continued)

*Primary Examiner* — Gary C Hoge
(74) *Attorney, Agent, or Firm* — Pablo Meles

(57) ABSTRACT

A display device includes a base holder having a cavity and a roller assembly. The roller assembly can include an upper cylindrical roller, a lower cylindrical roller, a framework arranged and constructed to maintain the upper cylindrical roller and the lower cylindrical roller a predetermined distance away from each other, and a conveyor belt wrapped around the upper cylindrical roller and the lower cylindrical roller. At least one or more rotating mechanisms can be attached to one or more of a left side of the upper cylindrical roller, a right side of the upper cylindrical roller, a left side of the lower cylindrical roller, or a right side of the lower cylindrical roller, where the one or more rotating mechanisms drive the lower cylinder to rotate and cause the conveyer belt to move around the upper cylinder and the lower cylinder.

19 Claims, 6 Drawing Sheets

(56) References Cited

U.S. PATENT DOCUMENTS

| | | | | |
|---|---|---|---|---|
| 5,622,504 | A | 4/1997 | Hance | |
| 6,498,597 | B1 | 12/2002 | Sawano | |
| 6,655,059 | B2 | 12/2003 | Perry et al. | |
| 2006/0132429 | A1* | 6/2006 | Ricks | G09F 9/30 345/108 |
| 2011/0041369 | A1* | 2/2011 | Uy | G09F 11/12 40/514 |

* cited by examiner

ROLLER DISPLAY DEVICE

CROSS-REFERENCE TO RELATED APPLICATIONS

This application claims priority under 35 U.S.C. Section 119(e) to U.S. Provisional Application No. 62/560,067 filed on Sep. 18, 2017, the entire content of which is incorporated herein by reference

FIELD OF THE DISCLOSURE

The present disclosure generally relates to systems and methods in the field of mechanical display devices, and more particularly relates to an innovative system and apparatus for posting and scrolling sticky notes or other messages on a rolling display device.

BACKGROUND

Many people use Post-it Notes or sticky notes and pile them or stick them to their display device or desk and lose site of them since they get buried beneath other notes or other documents or items that might be placed on the desk or behind other notes that might get stuck on a screen or other item on the desk. Eventually, the urgency or relevance of a particular older note gets lost due to other new notes that get piled on top.

It is desirable to find improved systems and apparatuses for maintaining notes, messages or sticky notes in an accessible unhidden way.

SUMMARY

In some embodiments, display device includes a base holder having a cavity and a roller assembly. The roller assembly can include an upper cylindrical roller, a lower cylindrical roller, a framework arranged and constructed to maintain the upper cylindrical roller and the lower cylindrical roller a predetermined distance away from each other, and a conveyor belt wrapped around the upper cylindrical roller and the lower cylindrical roller. The roller assembly is configured for vertical placement in the cavity of the base holder and at least one or more rotating mechanisms can be attached to one or more of a left side of the upper cylindrical roller, a right side of the upper cylindrical roller, a left side of the lower cylindrical roller, or a right side of the lower cylindrical roller, where the one or more rotating mechanisms drive the lower cylinder to rotate and cause the conveyer belt to move around the upper cylinder and the lower cylinder.

DETAILED DESCRIPTION

Glossary of Terms

Cavity—is an empty space or volume.

Framework—is a set of members forming a supporting structure.

Rotating mechanism—is a dial, knob, handle, crank or other element coupled to any number of rollers to facilitate the rotating of the roller and/or a corresponding conveyor belt about one or more of the rollers Sticky note—is any form of temporarily adhering note that can stick to the surface of the conveyor surface. A particular brand of sticky note is the Post it note by 3M.

Described herein is a display device for use with sticky notes or Post-it notes, and a method of using same. In the following description, numerous specific details are set forth in order to provide a thorough understanding of various embodiments of the display device and method. It will be apparent, however, to one skilled in the art that embodiments herein may be practiced without some or all of these specific details. In other instances, well known steps and/or structures have not been described in order to not unnecessarily obscure the display device or apparatus.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value. The modifier "about" used in combination with a quantity is inclusive of the stated value.

In this specification and the claims that follow, singular forms such as "a", "an", and "the" include plural forms unless the content clearly dictates otherwise.

In some embodiments, the display device or apparatus according to the present disclosure may be two or more rollers coupled via framework and a conveyer forming an assembly where the display device includes a mechanism for rotating the rollers and thereby moving the conveyer correspondingly. The assembly can be further placed within a cavity of a base holder or structure.

Figure 1:
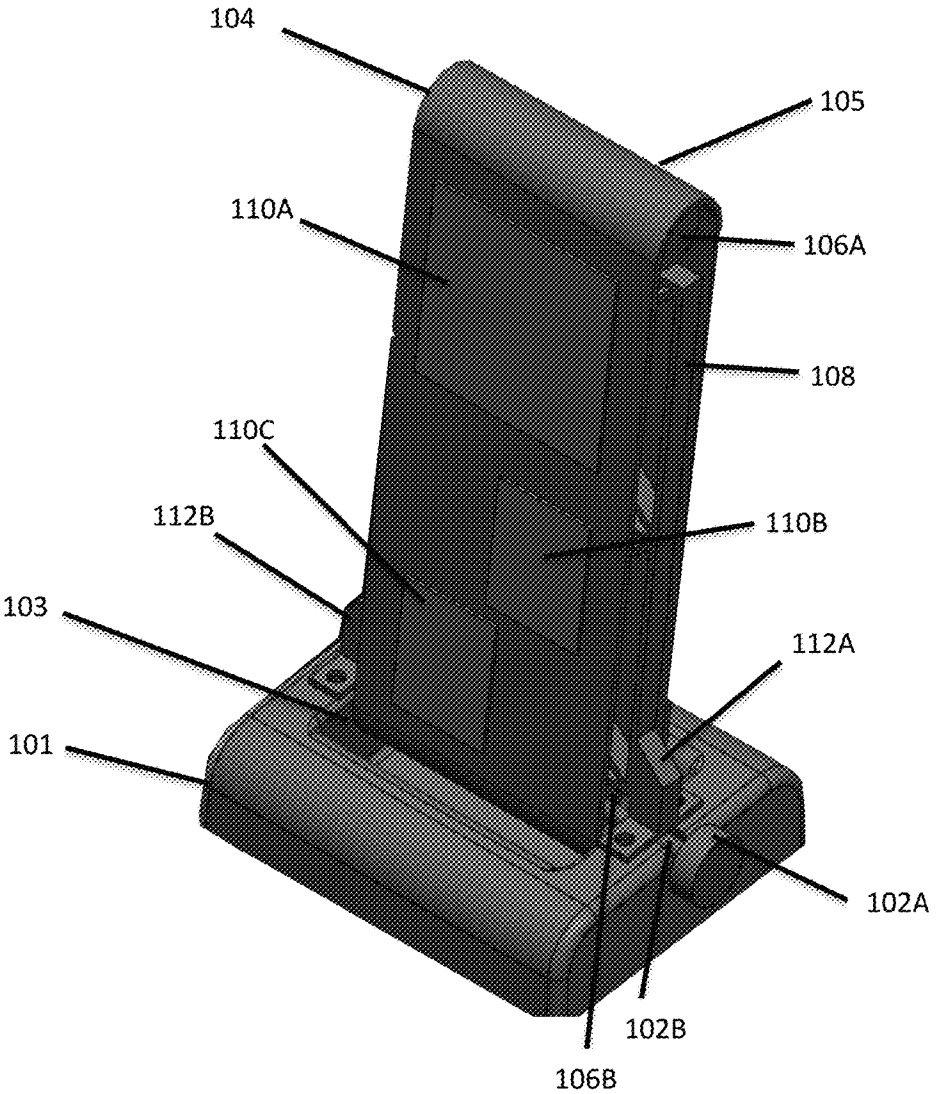
FIG. 1 illustrates a front left perspective view of a display device according to one embodiment of the disclosure.

In some embodiments and referring to FIG. 1, a display device 100 includes a base holder 101 having a cavity 103 and a roller assembly 105. The roller assembly 105 can include an upper cylindrical roller 106A, a lower cylindrical roller 106B, a framework 108 arranged and constructed to maintain the upper cylindrical roller 106A and the lower cylindrical roller 106B a predetermined distance away from each other, and a conveyor belt 104 wrapped around the upper cylindrical roller 106A and the lower cylindrical roller 106B. The roller assembly 105 is configured for vertical placement in the cavity 103 of the base holder 101 and at least one or more rotating mechanisms 102A can be attached to one or more of a left side of the upper cylindrical roller, a right side of the upper cylindrical roller, a left side of the lower cylindrical roller, or a right side of the lower cylindrical roller, where the one or more rotating mechanisms drive the lower cylindrical roller 106B to rotate and cause the conveyer belt 104 to move around the upper cylindrical roller 106A and the lower cylindrical roller 106B. In the embodiment of FIG. 1, the rotating mechanism 102A is a knob or dial coupled to the lower cylindrical roller 106B via a stem or post 102B. The base holder 101 can further include a locking mechanism including a left side mounting post 112A and a right side mounting post 112B used for securing the roller assembly 105 to the base holder 101 in a vertical configuration. The vertical configuration enables the placement and viewing of a single sticky note or Post it note or any number of sticky notes (or Post-it notes) 110A, 110B, 110C, etc., on the conveyor belt 104 of the roller assembly 105. The dimensions of the conveyer and roller assembly can be sized to allow a predetermined number of standard size sticky notes. The embodiments are not limited to any particular number of sticky notes that can be placed on the conveyor. Additional sticky notes or Post-it notes can also be placed on the opposing side of the conveyor belt shown. A rotation of the dial or knob 102A would move the notes (110A, etc.) in a cyclical fashion as the conveyor is rotated correspondingly.

In some embodiments, the rotating mechanism or mechanisms (102A) can be one or more of rotating dials, handles, or knobs. In some embodiments, the framework 108 can include a first framework for the lower cylindrical roller 106B and a second framework for the upper cylindrical roller 106A. In some embodiments, the conveyer belt 104 comprises smooth flexible vinyl. In some embodiments the vinyl can be electrostatically charged to retain the non-adhesive portions of the sticky notes adhering to the vinyl conveyor belt. In other embodiments, it is preferable to have the non-adhesive portion loose and apart from the conveyor belt surface. In yet other embodiments, the base further comprises an actuator, switch or button 120 (shown in FIG. 3) coupled to a battery and further coupled to a motor to drive a rotating motion for the lower cylindrical roller upon actuation of the actuator.

In some embodiments, the base holder and roller assembly are made of one or more of metal, plastic, or wood. In some embodiments, the upper cylindrical roller is configured to stay stationary relative to the lower cylindrical roller and the conveyor belt. In some embodiments, both the lower cylindrical roller and the upper cylindrical roller move in conjunction with the conveyor. In some embodiments, the lower cylindrical roller is configured to stay stationary relative to the upper cylindrical roller and the conveyor belt.

In some embodiments, the display device can be considered a sticky note caddy. In some embodiments, the display device is a vertically positioned conveyer belt system that sits on a weighted base for stability.

Figure 2:
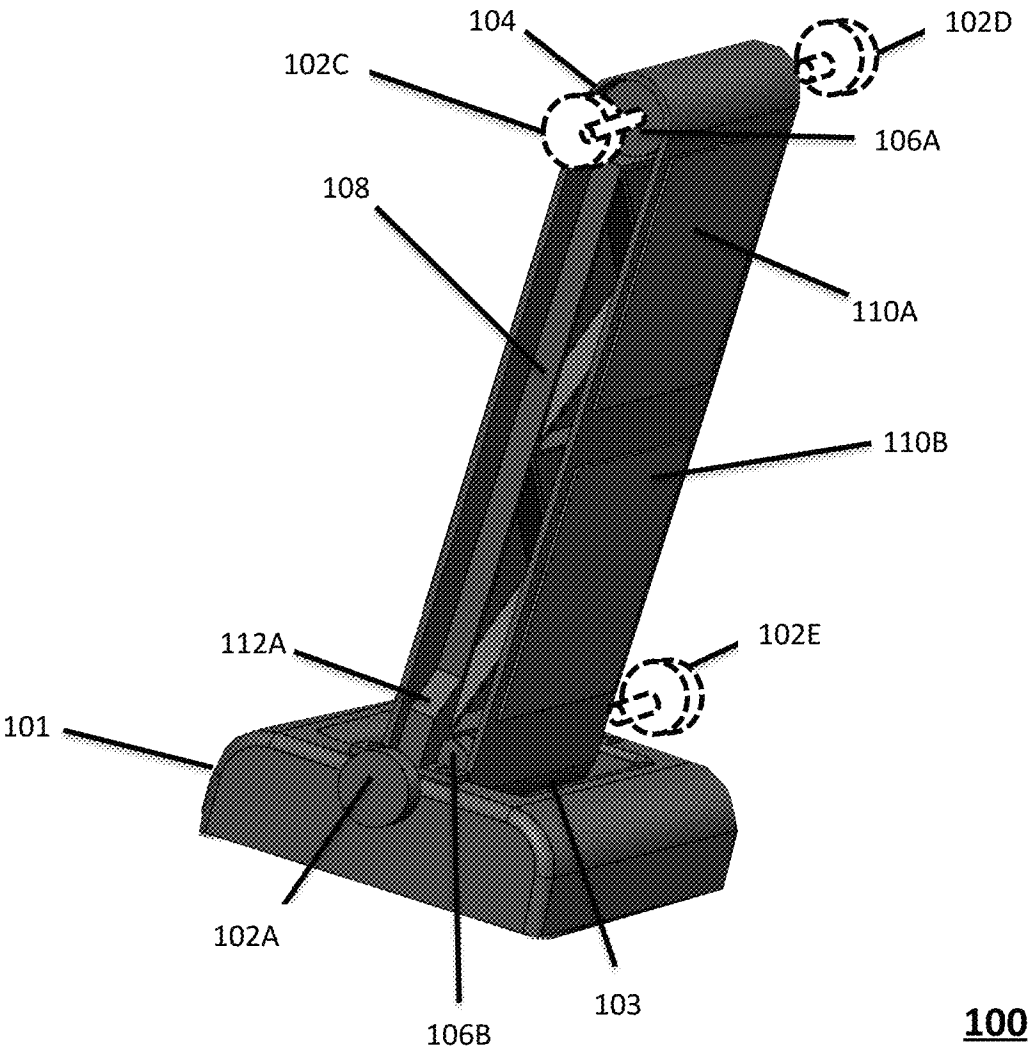
FIG. 2 illustrates a left rear perspective view of a display device in accordance with the embodiment of the disclosure.

Referring to FIG. 2, the display device 100 can have a single rotating mechanism 102A or one or more rotating mechanisms (102A, 102C, 102D, and/or 102E). The display device 100 can be configured to have any combination of rotating mechanism in any of the locations noted such as the right side of the lower cylindrical roller, the left side of the lower cylindrical roller, the right side of the upper cylindrical roller, and/or the left side of the upper cylindrical roller.

Figure 3:
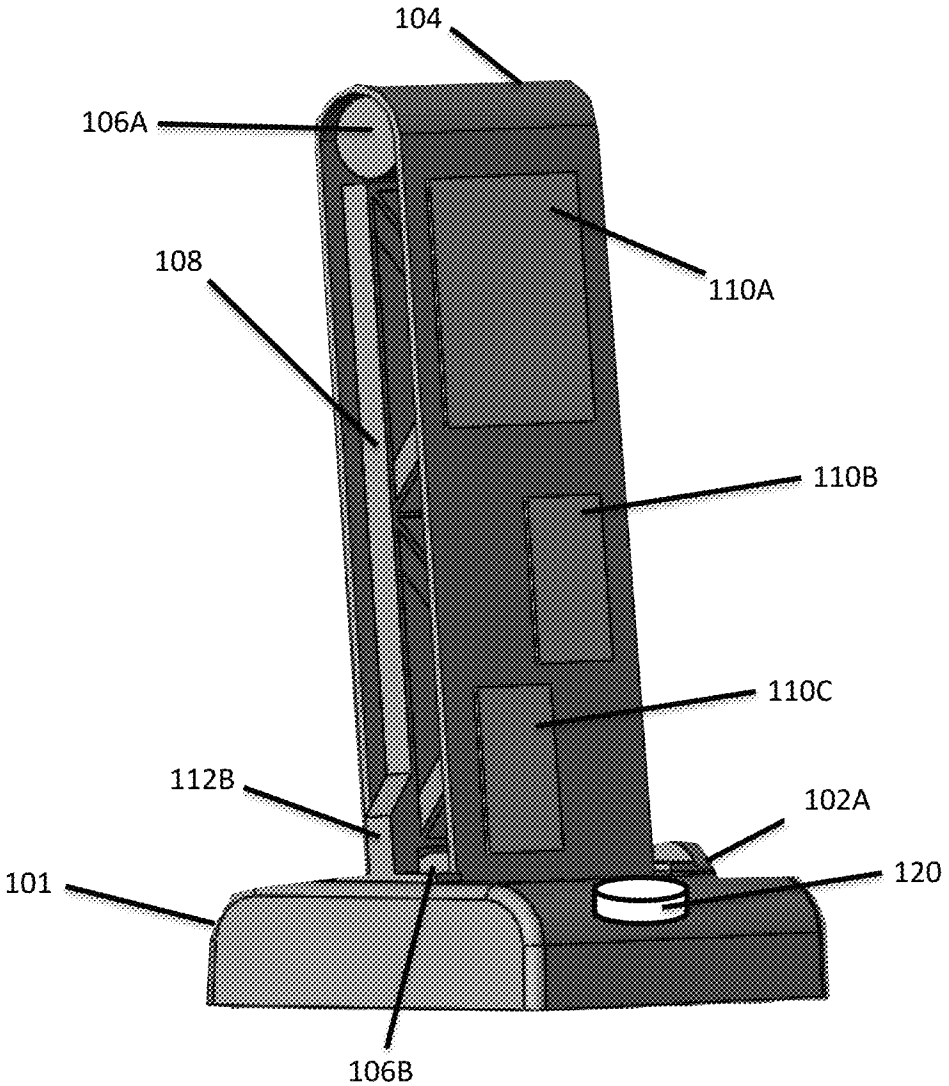
FIG. 3 illustrates a front right perspective of the display device of FIG. 1 in accordance with an embodiment of the disclosure.

Referring to FIG. 3, the display device 100 can further optionally include the actuator device or button 120 that can enable the application of power of a battery to a small motor to enable the automated motorized rotation of the conveyor belt.

Figure 4:
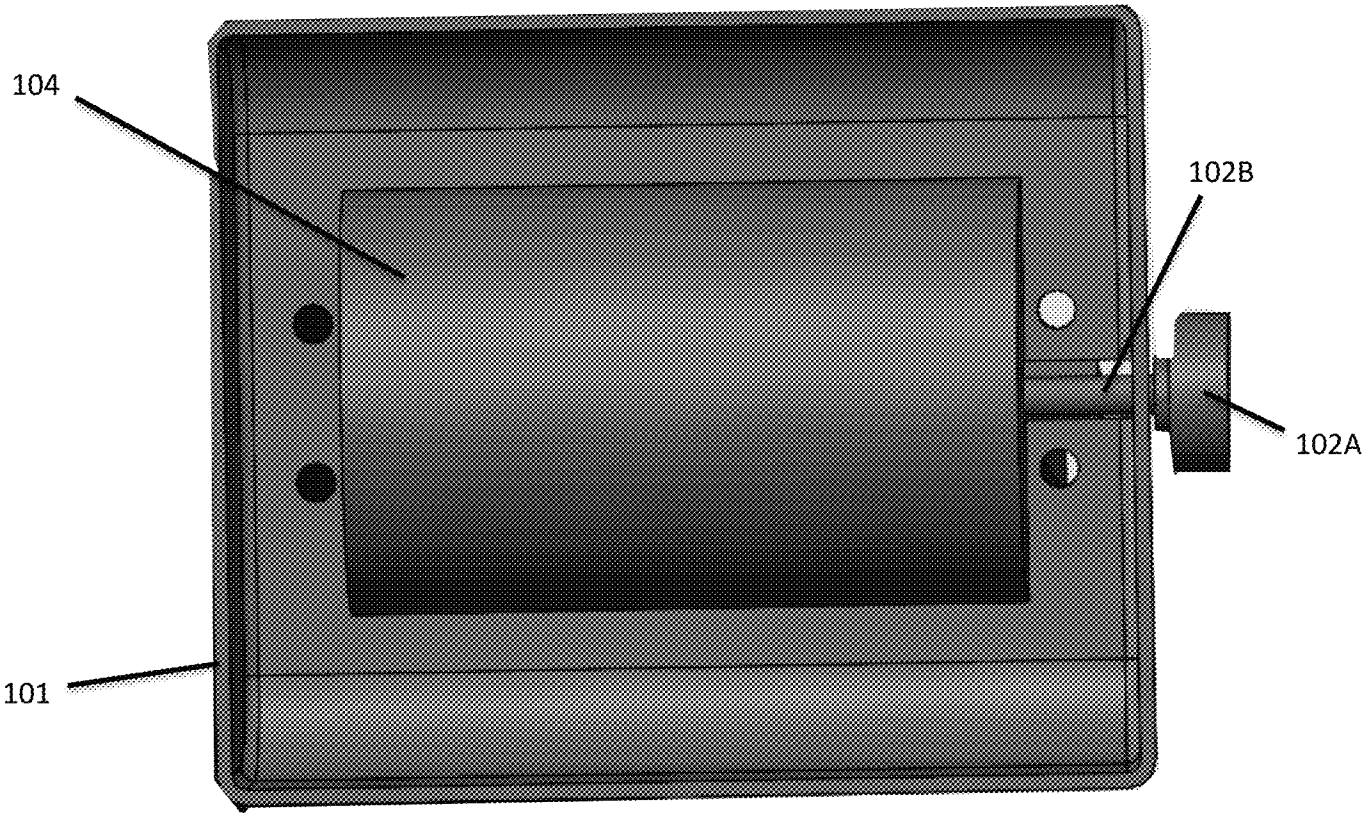
FIG. 4 illustrates a bottom plan view of the display device of FIG. 1 in accordance with an embodiment of the disclosure.

Referring to FIG. 4, a bottom plan view of the display device 100 shows the base holder 101, the conveyor belt 104, as well as the rotating mechanism 102A and stem or coupling element 102B that couples to the lower cylindrical roller 106B (shown in FIGS. 1-3).

Figure 5:
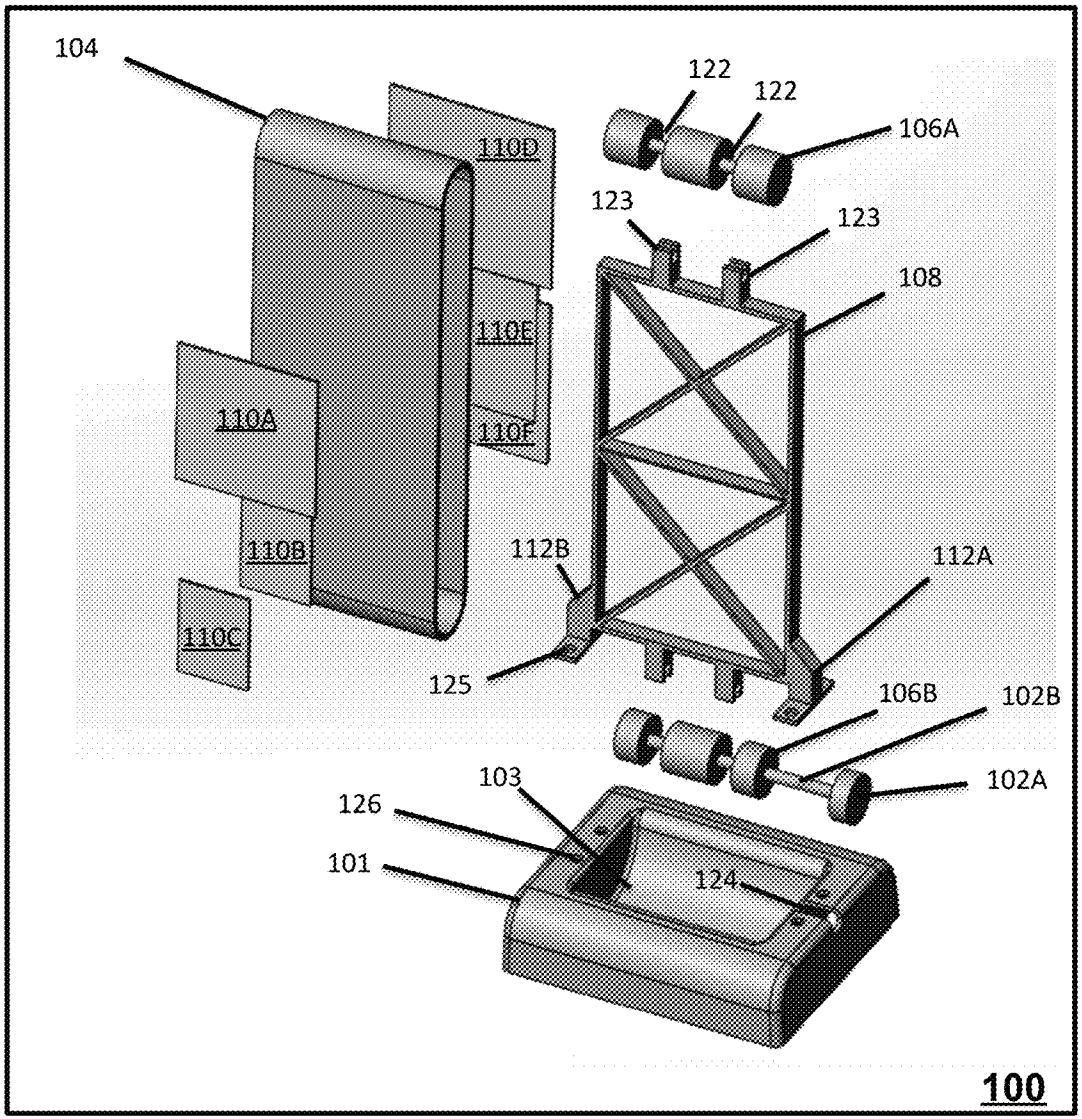
FIG. 5 illustrates an vertical exploded view of the display device of FIG. 1 in accordance with an embodiment of the disclosure.

Referring to FIG. 5, a vertical exploded view of the display device 100 provides greater detail with respect to the framework 108 and other components making up the roller assembly as well as the base holder 101. The roller assembly 105 (See FIG. 1) includes the conveyor belt 104 which would be mounted on the upper cylindrical roller 106A and the lower cylidrical roller 106B. The conveyor belt is shown with sticky notes 110A, 110B, and 110C on a front side and sticky notes 110D, 110E, and 110F on a rear or back side. In some embodiments, the cylindrical rollers can be complete cylinders. In the embodiment shown, the cylindrical rollers include gaps that exposes stem portions 122. The stem portions 122 are configured to snap or mate with posts or bosses 123 forming a portion of the framework 108. In assembly, the cylindrical rollers 106A and 106B can be simply snapped on to the respective posts or bosses 123 via the respective stems 122 on the cylindrical rollers. Thereafter, the conveyor belt 104 can be placed over the cylindrical rollers 106A and 106B to form the roller assembly (105). The roller assembly can be mounted to the base holder 101 using machine screws or other attachment devices (not shown) using the respective holes 125 at a base of the mounting posts 112A and 112B and the respective holes 126 in the base holder 101. As shown, the lower cylindrical roller 106B has an extension or stem 102B that couples to the rotating mechanism 102A in the form of a dial or knob. The stem 102B can fit within a slot 124 within the base 101 allowing the cylindrical roller 106B to rotate.

In one particular embodiment, at the base-bottom level of the conveyer belt is a cylindrical like tube approximately 4 to 5 inches wide and 1.5 inches in diameter. At the top end of the conveyer belt is another cylindrical like tube also 4 to 5 inches wide and 1.5 inches in diameter. The first tube is mounted on an inner frame just above the base. The second tube is suspended 12 inches above the bottom tube with an inner framework. The conveyer belt is wrapped around the two tubes. The conveyer material can be of a smooth flexible vinyl, but other materials are contemplated such as rubber, elastic, or elastomeric materials The bottom cylindrical tube can have a dial handle on one end or in alternative embodiments the bottom or top cylindrical tube can have a dial on either end or on each end. The dial enables the cylinders to rotate and move the conveyer belt around the two cylinders. Sticky notes can be affixed to the conveyer belt in any desired order and moved up or down on the belt as tasks are completed. The base can be modified to support a small motor and battery to motorize the belt using a push button. Materials for the entire device could include choices of metal, plastic and or wood depending on the desired décor. There could also be several models in different heights and widths.

Figure 6:
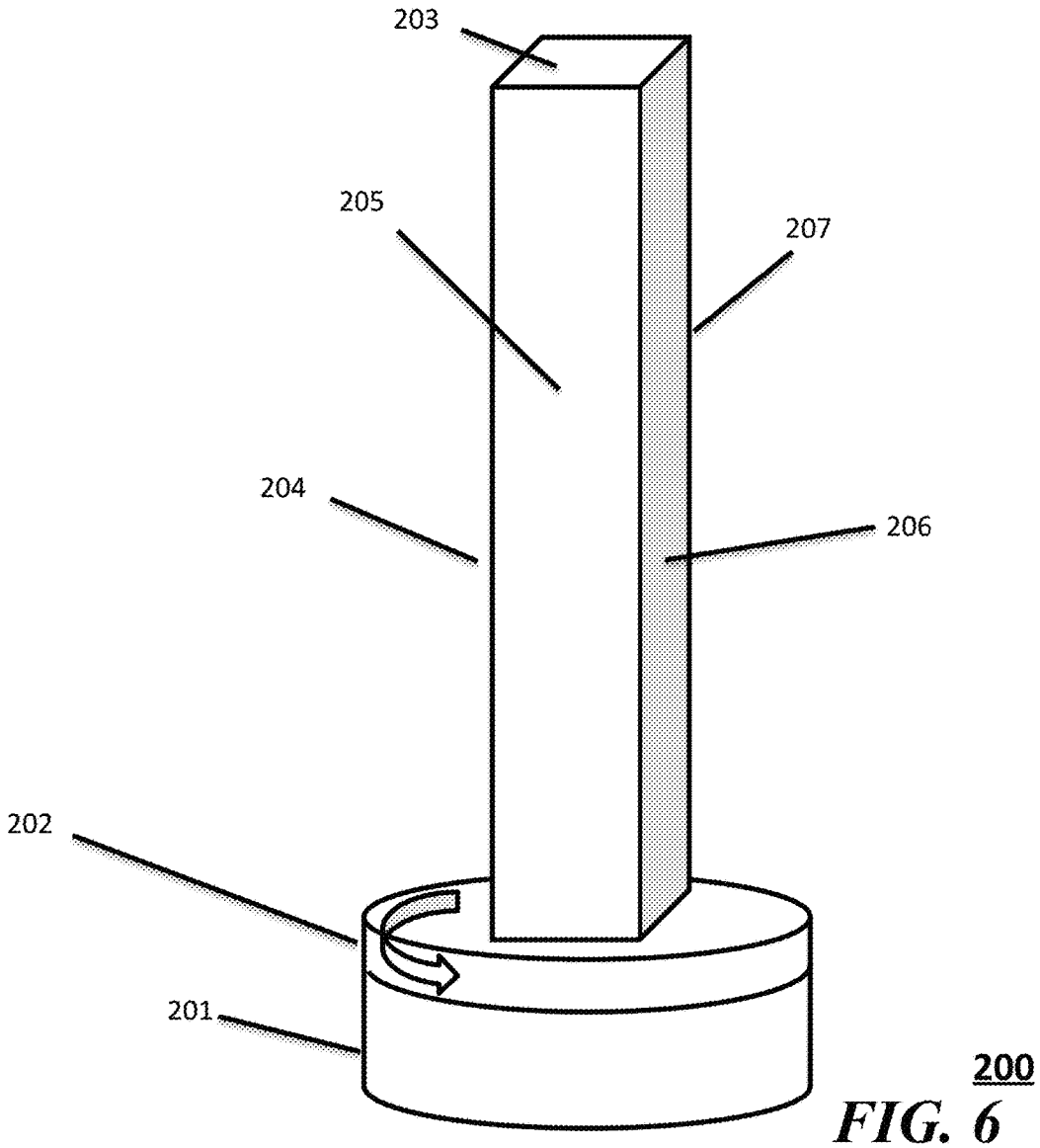
FIG. 6 illustrates a perspective view of an alternative display device according to another embodiment of the disclosure.

FIG. 6 illustrates an alternative display device 200 in accordance with an embodiment of the disclosure. The display device 200 can serve as a rotating post-it caddy and can include a base plate or base member 201 which can be weighted and a top plate or rotating member 202 that rotates relative to the weighted base member 201 similar in operation to a "lazy susan". A bearing (not shown) can be mounted between the base plate or base member and the top plate or rotating member to enable the smooth rotation of the top plate relative to the base plate. The display device further includes a tower member 203 mounted or fixed to the top plate or rotating member 202. The tower member 203 can have multiple faces or sides 204, 205, 206, and 207. The embodiment shown includes a tower 203 with 4 sides, but other embodiments within the scope of the disclosure herein can have a laminar tower with just two sides, or a tower with 3 sides, or 5 sides or more sides and even a circular or tubular tower. The tower can be made of plastic or any other material that enables the posting and removal of sticky notes.

It will be appreciated by those skilled in the art that the present invention can be embodied in other specific forms without departing from the spirit or essential characteristics thereof. The presently disclosed embodiments are therefore considered in all respects to be illustrative and not restricted. Modifications and variations are possible in light of the above teachings or may be acquired from practicing of the disclosure, without departing from the breadth or scope.

What is claimed is:

1. A display device, comprising:

a base holder having a cavity;

a roller assembly, the roller assembly comprising:

an upper cylindrical roller;

a lower cylindrical roller;

a framework arranged and constructed to maintain the upper cylindrical roller and the lower cylindrical roller a predetermined distance away from each other;

a conveyor belt wrapped around the upper cylindrical roller and the lower cylindrical roller;

wherein the roller assembly is configured for vertical placement in the cavity of the base holder;

at least one or more rotating mechanisms attached to one or more of a left side of the upper cylindrical roller, a right side of the upper cylindrical roller, a left side of the lower cylindrical roller, or a right side of the lower cylindrical roller, wherein the one or more rotating mechanisms drive the lower cylinder to rotate and causing the conveyer belt to move around the upper cylindrical roller and the lower cylindrical roller; and wherein further the upper cylindrical roller is configured to stay stationary relative to the lower cylindrical roller and the conveyor belt or the lower cylindrical roller is configured to stay stationary relative to the upper cylindrical roller and the conveyor belt.

2. The display device of claim 1, wherein the rotating mechanisms are one or more of rotating dials, handles, or knobs.

3. The display device of claim 1, wherein the framework comprises a first framework for the lower cylindrical roller and a second framework for the upper cylindrical roller.

4. The display device of claim 1, wherein the conveyer belt comprises smooth flexible vinyl.

5. The display device of claim 1, wherein the base holder and roller assembly are made of one or more of metal, plastic, or wood.

6. The display device of claim 1, wherein the conveyor belt is configured for placement of one or more sticky notes.

7. The display device of claim 1, wherein the upper cylindrical roller is configured to stay stationary relative to the lower cylindrical roller and the conveyor belt.

8. The display device of claim 1, wherein the upper cylindrical roller is configured to rotate correspondingly with the lower cylindrical roller and the conveyor belt.

9. The display device of claim 1, wherein the lower cylindrical roller is configured to stay stationary relative to the upper cylindrical roller and the conveyor belt.

10. The display device of claim 1, wherein the upper cylindrical roller and the lower cylindrical roller further includes gaps exposing a stem that is configured to mate with respective posts that are coupled to the framework.

11. The display device of claim 1, wherein the lower cylindrical roller further comprises an extension or stem coupled to one of the at least one or more rotating mechanisms that forms a knob or dial for rotating the conveyor about the upper and lower cylindrical rollers.

12. A display device, comprising:

a base holder having a cavity;

a roller assembly, the roller assembly comprising:

an upper cylindrical roller;

a lower cylindrical roller;

a framework arranged and constructed to maintain the upper cylindrical roller and the lower cylindrical roller a predetermined distance away from each other;

a conveyor belt wrapped around the upper cylindrical roller and the lower cylindrical roller; and wherein the roller assembly is configured for vertical placement in the cavity of the base holder;

wherein the upper cylindrical roller and the lower cylindrical roller further includes gaps exposing a stem that is configured to mate with respective posts that are coupled to the framework; and at least one or more rotating mechanisms for causing the conveyer belt to move around the upper cylindrical roller and the lower cylindrical roller.

13. The display device of claim 12, wherein the rotating mechanisms are one or more of rotating dials, handles, or knobs.

14. The display device of claim 12, wherein the at least one or more rotating mechanisms is attached to one or more of a left side of the upper cylindrical roller, a right side of the upper cylindrical roller, a left side of the lower cylindrical roller, or a right side of the lower cylindrical roller.

15. The display device of claim 12, wherein the one or more rotating mechanisms drive the lower cylinder to rotate.

16. A display device, comprising:

a base holder having a cavity;

a roller assembly, the roller assembly comprising:

an upper cylindrical roller;

a lower cylindrical roller;

a framework arranged and constructed to maintain the upper cylindrical roller and the lower cylindrical roller a predetermined distance away from each other;

a conveyor belt wrapped around the upper cylindrical roller and the lower cylindrical roller; and at least one or more rotating mechanisms for causing the conveyer belt to move around the upper cylindrical roller and the lower cylindrical roller, wherein the upper cylindrical roller is configured to stay stationary relative to the lower cylindrical roller and the conveyor belt or the lower cylindrical roller is configured to stay stationary relative to the upper cylindrical roller and the conveyor belt.

17. The display device of claim 16, wherein the roller assembly is configured for vertical placement in the cavity of the base holder.

18. The display device of claim 16, wherein the conveyor belt is configured for placement of one or more sticky notes.

19. The display device of claim 16, wherein the at least one or more rotating mechanisms is attached to one or more of a left side of the upper cylindrical roller, a right side of the upper cylindrical roller, a left side of the lower cylindrical roller, or a right side of the lower cylindrical roller and wherein the one or more rotating mechanisms drive the lower cylinder to rotate.

* * * * *